US006300920B1

(12) United States Patent
Pertl et al.

(10) Patent No.: US 6,300,920 B1
(45) Date of Patent: Oct. 9, 2001

(54) ELECTROMAGNETIC ANTENNA

(75) Inventors: Franz A. Pertl; Robert P. M. Craven, both of Morgantown; James E. Smith, Bruceton Mills, all of WV (US)

(73) Assignee: West Virginia University, Morgantown, WV (US)

( * ) Notice: Subject to any disclaimer, the term of this patent is extended or adjusted under 35 U.S.C. 154(b) by 0 days.

(21) Appl. No.: 09/637,525

(22) Filed: Aug. 10, 2000

(51) Int. Cl.[7] ..... H01Q 1/36; H01Q 11/12
(52) U.S. Cl. ..... 343/895; 343/742; 343/744
(58) Field of Search ..... 343/742, 744, 343/748, 788, 866, 867, 870, 895

(56) References Cited

U.S. PATENT DOCUMENTS

| | | | | |
|---|---|---|---|---|
| 3,284,801 | | 11/1966 | Bryant . | |
| 3,646,562 | | 2/1972 | Acker et al. . | |
| 3,671,970 | | 6/1972 | Layton . | |
| 3,721,989 | | 3/1973 | Christensen . | |
| 4,622,558 | | 11/1986 | Corum . | |
| 4,751,515 | | 6/1988 | Corum . | |
| 4,999,642 | | 3/1991 | Wells . | |
| 5,159,332 | | 10/1992 | Walton . | |
| 5,257,033 | | 10/1993 | Roche . | |
| 5,442,369 | | 8/1995 | Van Voorhies et al. . | |
| 5,654,723 | | 8/1997 | Craven et al. . | |
| 5,734,353 | | 3/1998 | Van Voorhies . | |
| 5,952,978 | | 9/1999 | Van Voorhies . | |
| 6,028,558 | * | 2/2000 | Van Voorhies | 343/741 |
| 6,204,821 | * | 3/2001 | Van Voorhies | 343/742 |

FOREIGN PATENT DOCUMENTS

| | | |
|---|---|---|
| 3823972 A1 | 1/1990 | (DE) . |
| 043591 A1 | 1/1982 | (EP) . |
| 7146386 | 6/1995 | (JP) . |

OTHER PUBLICATIONS

J.M. Ham, et al., "Time–Varying Electric and Magnetic Fields," Scientific Basis of Electrical Engineering, pp. 302–305, 1961.

Howard W. Sams, Reference Data for Radio Engineers, 7th Ed. E.C. Jordan Ed., pp. 6–13—6–14.

Kandoian, A.G., et al., "Wide Frequency–Range Tuned Helical Antennas and and Circuits," Fed. Telecommunication Laboratories, Inc., pp. 42–47, 1953.

Birdsall, C.K., et al., "Modified Contra–Wound Helix Circuits for High–Power Traveling–Wave Tubes," IRE Transactions on Electron Devices, pp. 190–206, Oct. 1956.

Harington, R.F., "Time Harmonic Electromagnetic Fields," pp. 106–111, 1961.

Van Voorhies, K.L., et al., "Energy and the Environment: A Continuing Partnership," 26th Intersociety Energy Conversion Engineering Conference, 6 pp., Aug. 1991.

* cited by examiner

*Primary Examiner*—Tan Ho
(74) *Attorney, Agent, or Firm*—Kirk D. Houser; Eckert Seamans Cherin & Mellott, LLC

(57) ABSTRACT

An electromagnetic antenna includes a multiply connected surface, such as a toroidal surface; a first conductive loop proximate to the toroidal surface; a second conductive loop proximate to the toroidal surface; first and second signal carrying terminals electrically or magnetically connected to the first and second conductive loops, respectively; and a plurality of conductive transceiver elements, such as plural pairs of contrawound insulated conductor windings. Each pair of the contrawound insulated conductor windings has a first end, a plurality of turns, and a second end, and extends around and at least partially about the toroidal surface. Each pair of these windings is electrically connected to the first and second conductive loops. The first end of the windings is electrically connected to one of the first and second conductive loops, and the second end of the windings is electrically connected to the other of the first and second conductive loops.

60 Claims, 14 Drawing Sheets

(3 of 14 Drawing Sheet(s) Filed in Color)

FIG. 1
PRIOR ART
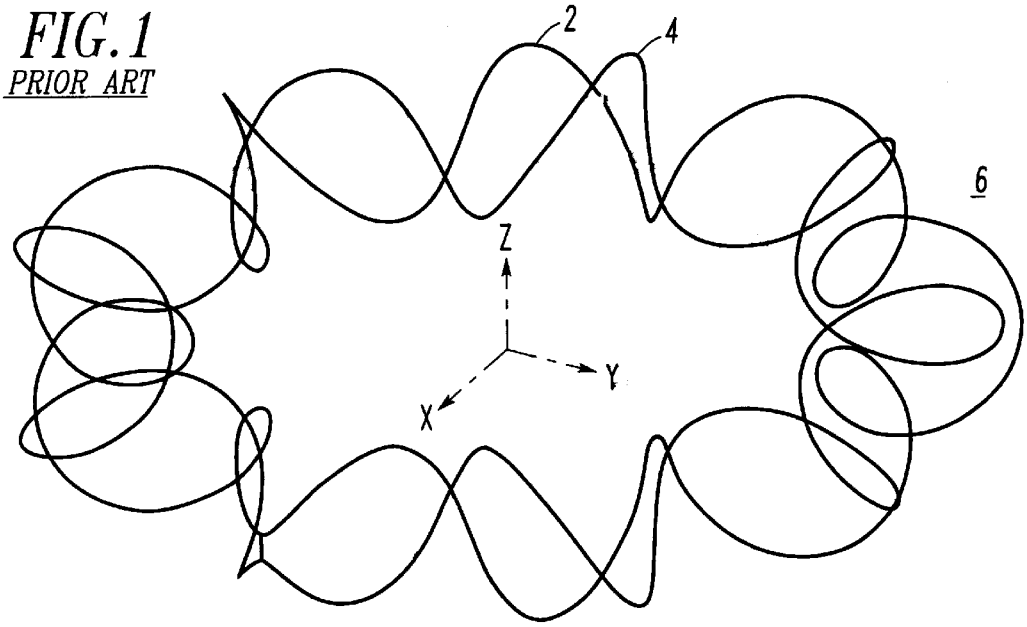
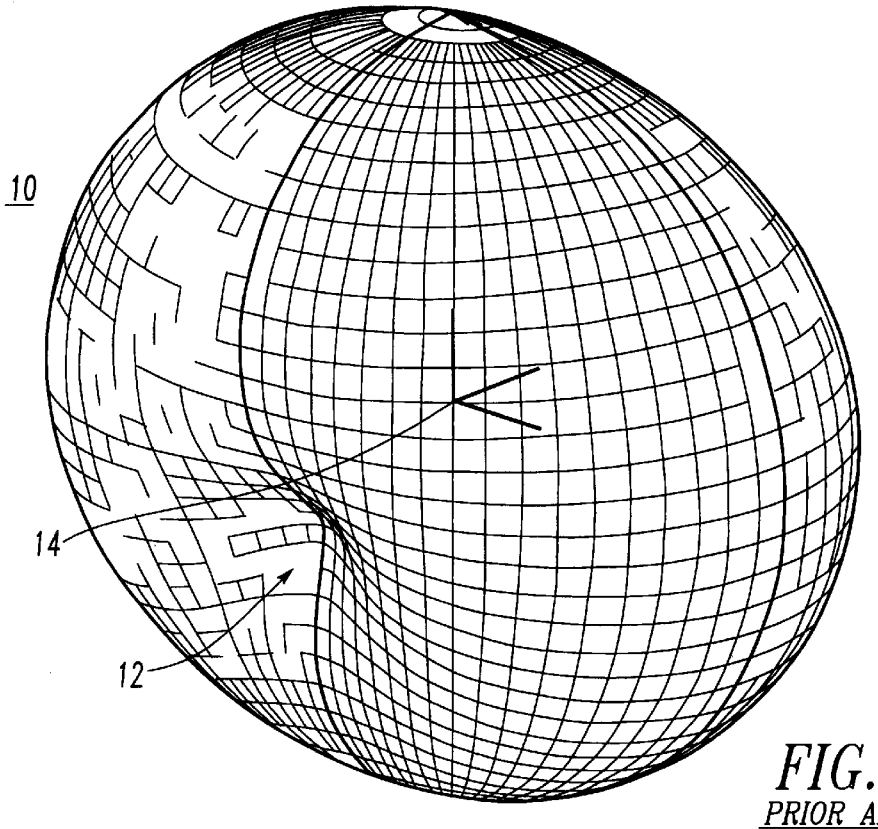
FIG. 3
PRIOR ART

FIG. 12
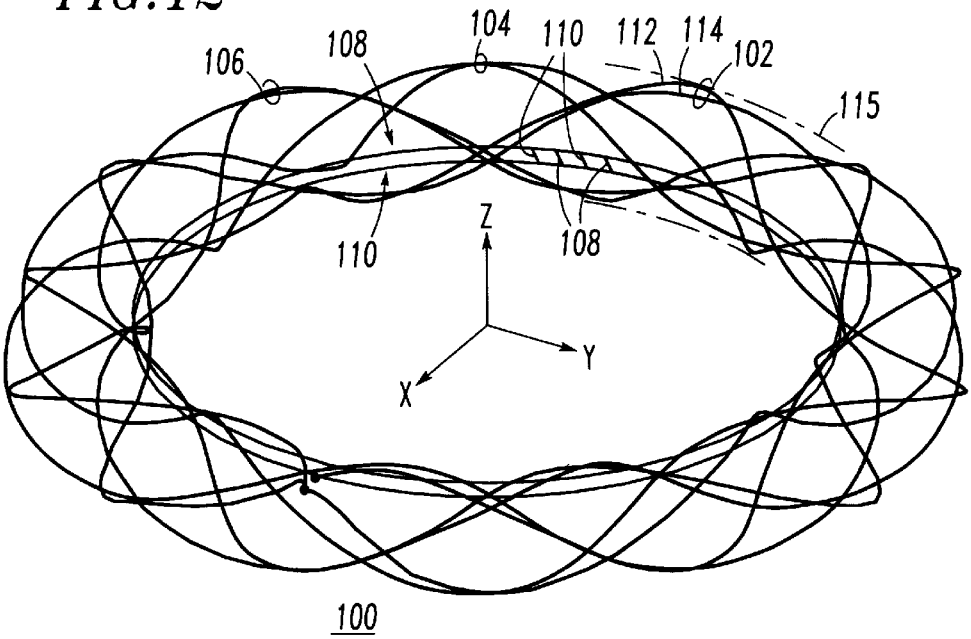
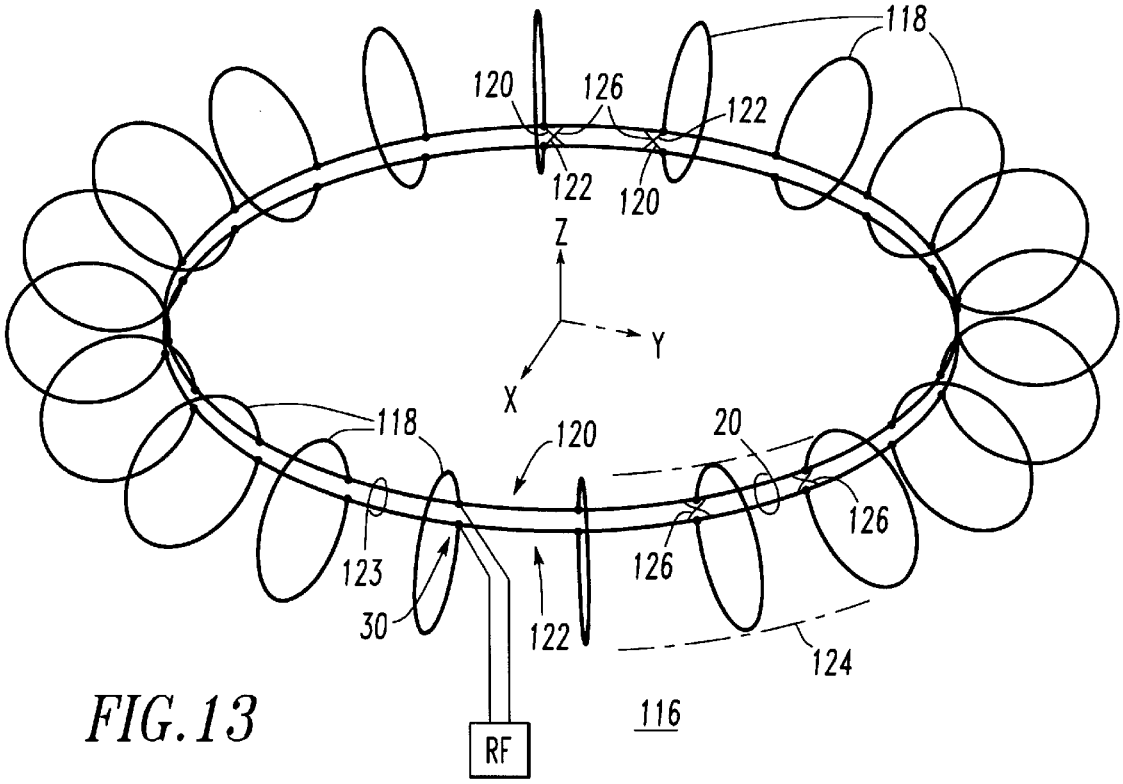
FIG. 13

FIG.20
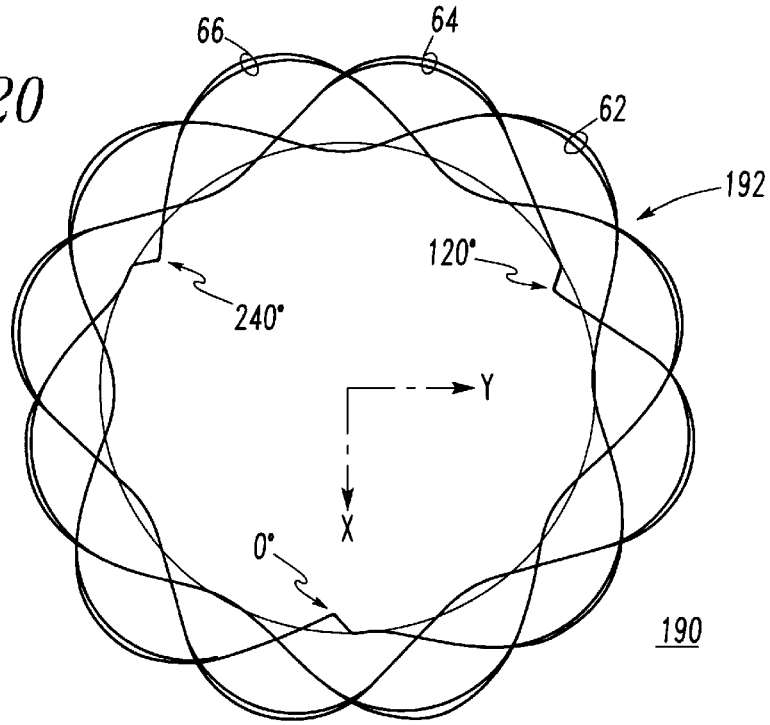
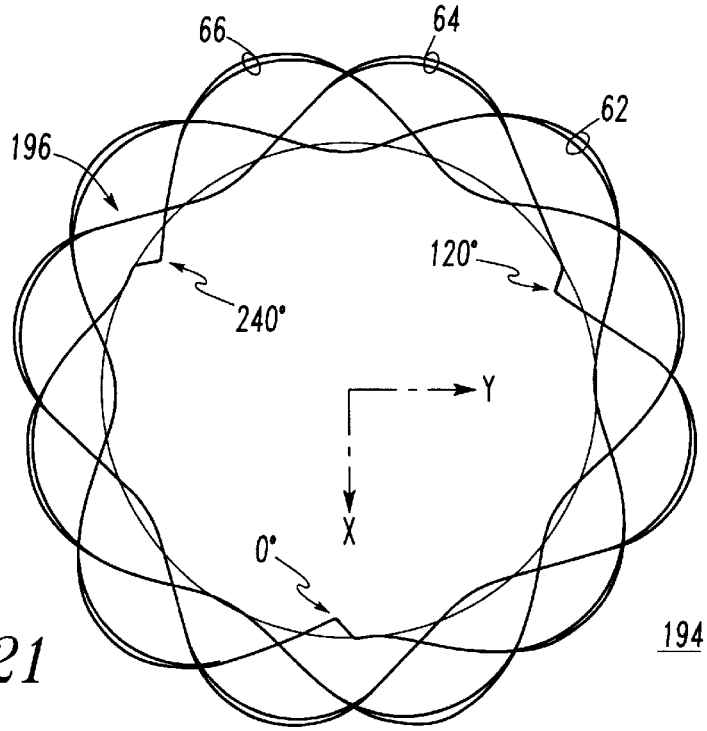
FIG.21

ELECTROMAGNETIC ANTENNA

BACKGROUND OF THE INVENTION

1. Field of the Invention

This invention relates to transmitting and receiving antennas, and, in particular, to antennas including a plurality of conductive transceiver elements having a plurality of turns.

2. Background Information

There is considerable incentive to decrease the height of antennas from that of the towering dipole to a more diminutive form while maintaining similar levels of efficiency and radiation pattern. It has long been thought that a horizontally oriented magnetic flux ring would be the best form for achieving this goal, although the implementation of a uniform magnetic flux ring is not simple or straightforward.

U.S. Pat. Nos. 4,622,558, 5,442,369, and 6,028,558 disclose three such attempts at producing rings of magnetic flux and, thereby, approaching the goal of dipole like radiation patterns. While each reference may achieve a different level of success, their weakness is that standing waves of current are not uniform about a toroidal surface and, hence, the ring of magnetic flux is not uniform. Therefore, the radiation pattern deviates from that of a dipole. See, also, U.S. Pat. Nos. 5,734,353; and 5,952,978.

U.S. Pat. No. 5,442,369 discloses, for example, an omnidirectional poloidal loop antenna employing inductive loops (FIG. 27), a cylindrical loop antenna (FIG. 31), a toroid with toroid slots for tuning and for emulation of a poloidal loop configuration (FIG. 33), and other toroidal antennas employing a toroid core tuning circuit (FIG. 34), a central capacitance tuning arrangement (FIG. 36), a poloidal winding arrangement (FIG. 37), and a variable capacitance tuning arrangement (FIG. 38).

The embodiments of FIG. 27 and 31 of U.S. Pat. No. 5,442,369 share the disadvantage of relatively large size because of the necessity for the poloidal loop circumference to be on the order of one half wavelength for resonant operation. U.S. Pat. No. 5,442,369 teaches that the loop size may be reduced by adding either series inductance or parallel reactance to those structures.

U.S. Pat. No. 5,654,723 discloses antennas having various geometric shapes, such as a sphere. For example, if a sphere is small with respect to wavelength, then the current distribution is uniform. This provides the benefit of a spherical radiation pattern, which approaches the radiation pattern of an ideal isotropic radiator or point source, in order to project energy equally in all directions. Other geometric shapes may provide similar benefits. Contrawound windings are employed to cancel electric fields and leave a magnetic loop current.

Referring to FIG. 1 hereof, two helical windings 2, 4 of a Contrawound Toroidal Helical Antenna (CTHA) 6 are shown. CTHAs are disclosed, for example, in U.S. Pat. Nos. 5,442,369; and 6,028,558, which are incorporated by reference herein. The contrawound helical windings 2, 4 are fed with opposite currents in order that the magnetic flux of each helix reinforces the loop magnetic flux. This additive effect of the two helices may produce a stronger magnetic flux than a single toroidal helix (not shown), but the magnetic flux is not uniform. The effect can approach uniform currents for an electrically small CTHA, but suffers poor efficiency.

FIG. 2 shows a plot 8 of the currents in the two helical windings 2, 4 of FIG. 1 at the half wavelength resonance as predicted by the Los Alamos National Laboratory's Numerical Electromagnetics Code (NEC). These non-uniform currents, in turn, produce non-uniform magnetic fields.

As shown in FIG. 3, the exemplary NEC simulation from FIG. 2 provides a plot 10 of a 3D-radiation (i.e., $\theta$ plus $\phi$) pattern having two dimples (only one dimple 12 is shown). This pattern about the X-Y-Z origin 14 is considerably different from the radiation pattern of a dipole (not shown). While not all CTHA antennas have as pronounced a dimple as the dimple 12, those antennas all share the characteristic of near isotropic radiation (i.e., there is no overhead null).

Since the best gain for an isotropic radiator is, by definition, 0 dBi, and the best gain of a dipole is about +2.5 dBi (e.g., about +2.57 to about +2.74 dBi), applications that only need azimuthal (e.g., horizontal in the exemplary embodiment) patterns suffer an apparent disadvantage when employing a CTHA. For these applications, there exists the need for a uniform magnetic ring.

Although the prior art shows various antenna structures, there is room for improvement.

SUMMARY OF THE INVENTION

The present invention provides an electromagnetic antenna, which preferably creates a nearly uniform ring-shaped magnetic field for use as a radiation source and/or a radiation receiver.

In accordance with the invention, an electromagnetic antenna includes a multiply connected surface; a first conductive loop proximate to the multiply connected surface; a second conductive loop proximate to the multiply connected surface; first and second signal carrying terminals operatively associated with the first and second conductive loops, respectively; and a plurality of conductive transceiver elements, each of the conductive transceiver elements has a first end, a plurality of turns, and a second end, with each of the conductive transceiver elements extending around and at least partially about the multiply connected surface, and with each of the conductive transceiver elements being electrically connected to the first and second conductive loops, with the first end of each of the conductive transceiver elements being electrically connected to one of the first and second conductive loops, and with the second end of each of the conductive transceiver elements being electrically connected to the other of the first and second conductive loops.

Preferably, the conductive transceiver elements include pairs of contrawound insulated conductor windings. Those windings may form contrawound helices or may be contrawound insulated conductor windings.

As other refinements, the conductive transceiver elements may include at least eight of the elements, or may be distributed about an equal portion of the first and second conductive loops.

Preferably, the multiply connected surface is a toroidal surface which includes a major circumference which extends 360 degrees from a 0 degree position back to a 360 degree position, which is the 0 degree position. The conductive transceiver elements include N pairs of contrawound toroidal helices. Each pair of the contrawound toroidal helices is distributed completely about the major circumference and the first and second conductive loops, with a first pair of the contrawound toroidal helices being electrically connected to the first and second conductive loops at the 0 degree position, with a second pair of the contrawound toroidal helices being electrically connected to the first and second conductive loops at a 360/N degree position, and with an "nth" pair of the contrawound toroidal helices being electrically connected to the first and second conductive loops at a 360(n−1)/N degree position.

As further refinements, the first and second conductive loops form a pair of parallel toroidal helices having the same pitch sense, or form a contrawound toroidal helical antenna.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

A full understanding of the invention can be gained from the following description of the preferred embodiments when read in conjunction with the accompanying drawings in which:

FIG. 1 is an isometric view of two helical windings in a Contrawound Toroidal Helical Antenna (CTHA) structure;

FIG. 3 is a plot of the radiation pattern of the CTHA of FIG. 1 for the current distribution of FIG. 2;

FIG. 12 is a plan view of another uniform magnetic ring antenna which employs three sets of contrawound toroidal helices and a pair of non-contrawound feed rings having the same pitch sense in accordance with another embodiment of the invention;

FIG. 13 is a plan view of another uniform magnetic ring antenna which employs a CTHA as the feed line and which distributes poloidal radiator rings about the toroid in accordance with another embodiment of the invention.

FIGS. 20 and 21 are plan views of uniform magnetic ring antennas having signal termination arrangements in accordance with other embodiments of the invention;

DESCRIPTION OF THE PREFERRED EMBODIMENTS

As employed herein the term "multiply connected surface" shall expressly include, but not be limited to: (a) any toroidal surface, such as a preferred toroid form having its major radius greater than or equal to its minor radius, or a toroid form having its major radius less than its minor radius (see, for example, U.S. Pat. No. 5,654,723); (b) other surfaces formed by rotating and transforming a plane closed curve or polygon having a plurality of different radii about an axis lying on its plane; and (c) still other surfaces, such as surfaces like those of a washer or nut such as a hex nut, formed from a generally planar material in order to define, with respect to its plane, an inside circumference greater than zero and an outside circumference greater than the inside circumference, with the outside and inside circumferences being either a plane closed curve and/or a polygon. Furthermore, such multiply connected surfaces may include surfaces formed on parallel layers of an air core or formed as a printed circuit board antenna.

Figure 2:
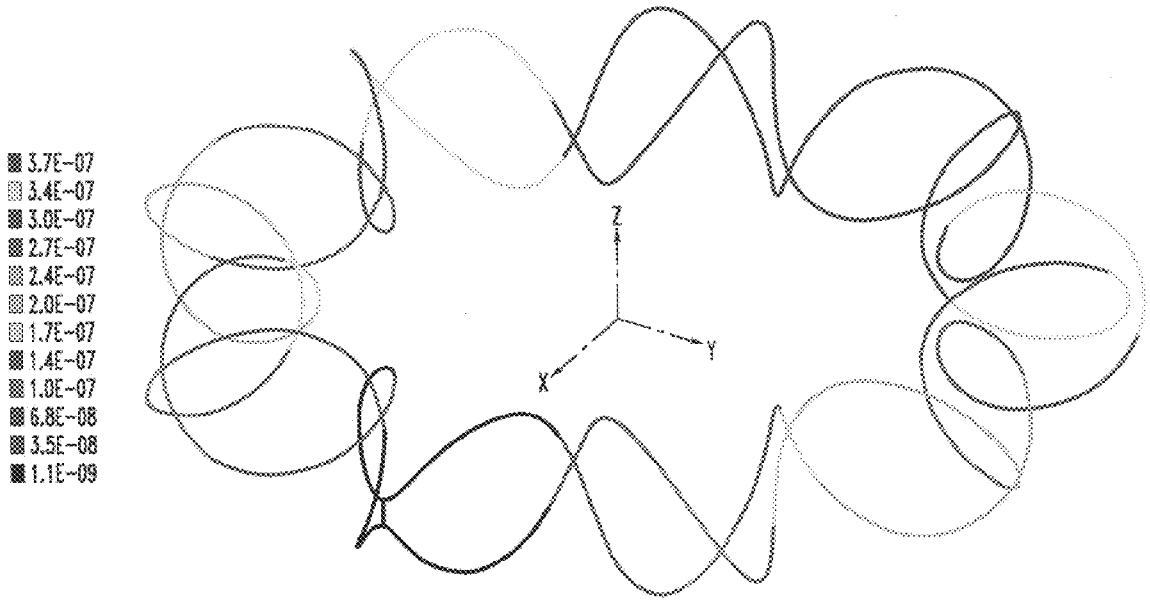
FIG. 2 is a plot, which shows the current distribution of the CTHA of FIG. 1 at a self-resonance.
Figure 4:
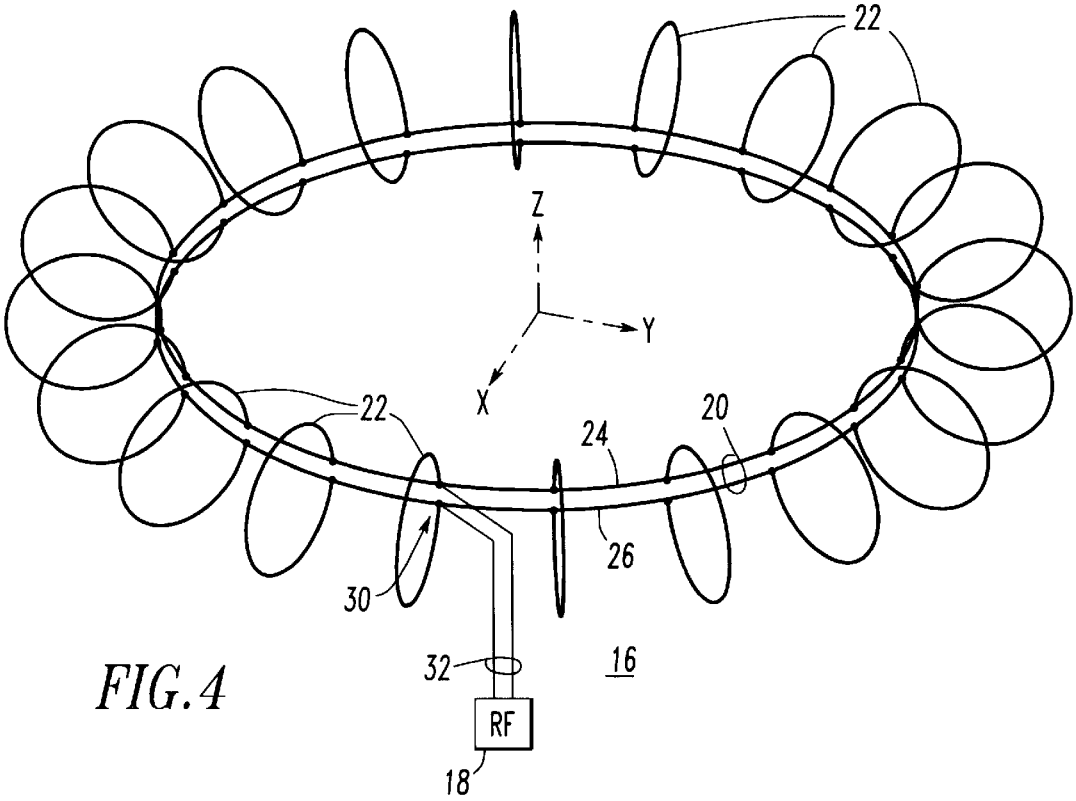
FIG. 4 is an isometric view of a uniform magnetic ring antenna.

Referring to FIG. 4, a uniform magnetic ring antenna 16 is shown in which radio frequency (RF) signal 18 is supplied by an exemplary horizontal circular feed transmission line 20 to a plurality of exemplary vertical rings 22. The rings 22, in turn, are distributed about the exemplary horizontal circle formed by the transmission line 20. At resonance, the exemplary antenna 16 produces similar currents in each of the vertical rings 22. These vertical rings 22, in turn, create a uniform magnetic ring and a dipole-like pattern. The magnetic ring that is created is uniform in magnitude for the time varying RF excitations. This structure and the method of excitation, thus, produce a radiation field, which is similar to that of an electric dipole antenna.

The antenna 16 of FIG. 4 is disclosed in terms of a transmitting antenna with an exemplary horizontal orientation, although all of the antennas disclosed herein are suitable for transmit and/or receive operation in any orientation (e.g., horizontal, vertical, and orientations therebetween).

In order to provide uniform current flow in each of the exemplary vertical rings 22, a potential difference is introduced between the two feed rings 24, 26 of the exemplary circular feed transmission line 20, which provides a suitable balanced transmission line to connect the relatively smaller vertical rings 22. The geometry of the exemplary structure ensures that the potential is constant in magnitude across each of the vertical rings 22. This, then, causes nearly equal magnitude currents to flow in each vertical ring 22, thereby creating the desired magnetic field.

Figure 5:
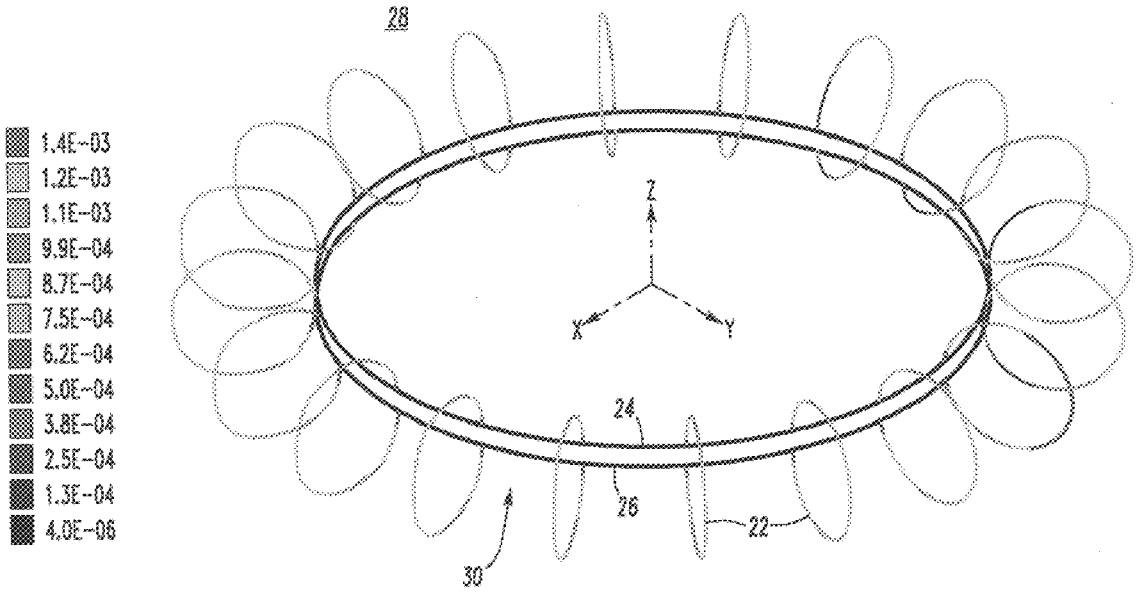
FIG. 5 is a plot of the current distribution of the ring structure of FIG. 4 at self-resonance.

FIG. 5 shows a plot 28 of the current distribution on the ring structure of FIG. 4 as simulated by NEC at the structure's resonant frequency. Preferably, the circumferential length of each of the exemplary vertical rings 22 of FIG. 4 is λ/2, wherein λ is the wavelength of the RF signal 18, with the circumferential length of each of the exemplary feed rings 24, 26 being normally on the order of λ, but in the example of FIG. 4, being preferably on the order of about 4 to 5 times λ. In this manner, the RF signal 18 naturally distributes to the other vertical rings 22 from the vertical ring at the feedport 30. Most of the vertical rings 22 show similar current distributions (e.g., about 0.13 mA to about 1.4 mA) and all of the high current regions exist in the vertical rings 22 with minimal standing wave currents in the transmission line feed rings 24, 26. The one vertical ring with a higher current than the others is connected to the feed point 30. The magnitude of this single aberrant ring may be reduced, for example, by feeding between two adjacent vertical rings 22.

Preferably, a coaxial cable 32 to a receiver (not shown) or from a transmitter (not shown) is employed to provide an electrical connection to a suitable matching network (not shown) and to the antenna 16 of FIG. 4.

Figure 6:
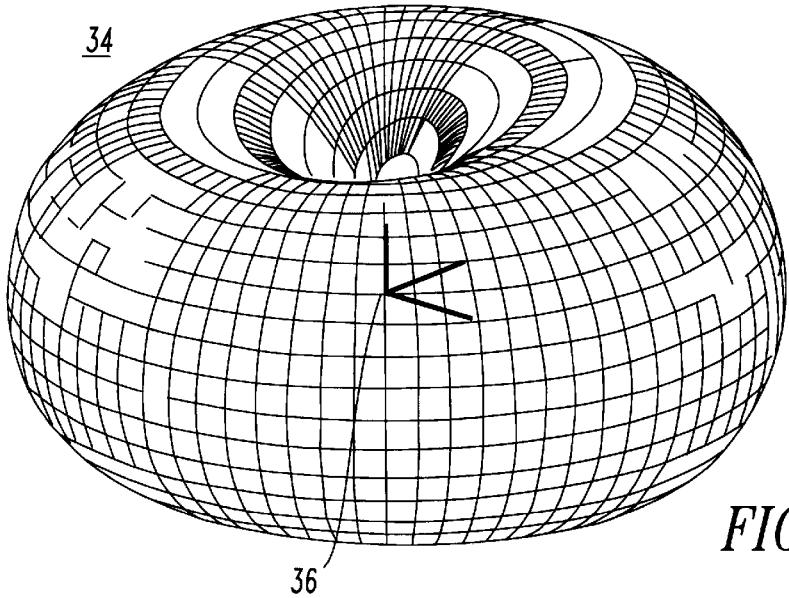
FIG. 6 is a plot of the radiation pattern of the antenna of FIG. 4 for the current distribution of FIG. 5.

As shown in FIG. 6, a plot 34 of the simulation results from NEC shows a dipole-like radiation pattern about origin 36 for the antenna 16 of FIG. 4 and the current distribution of FIG. 5.

Figure 7:
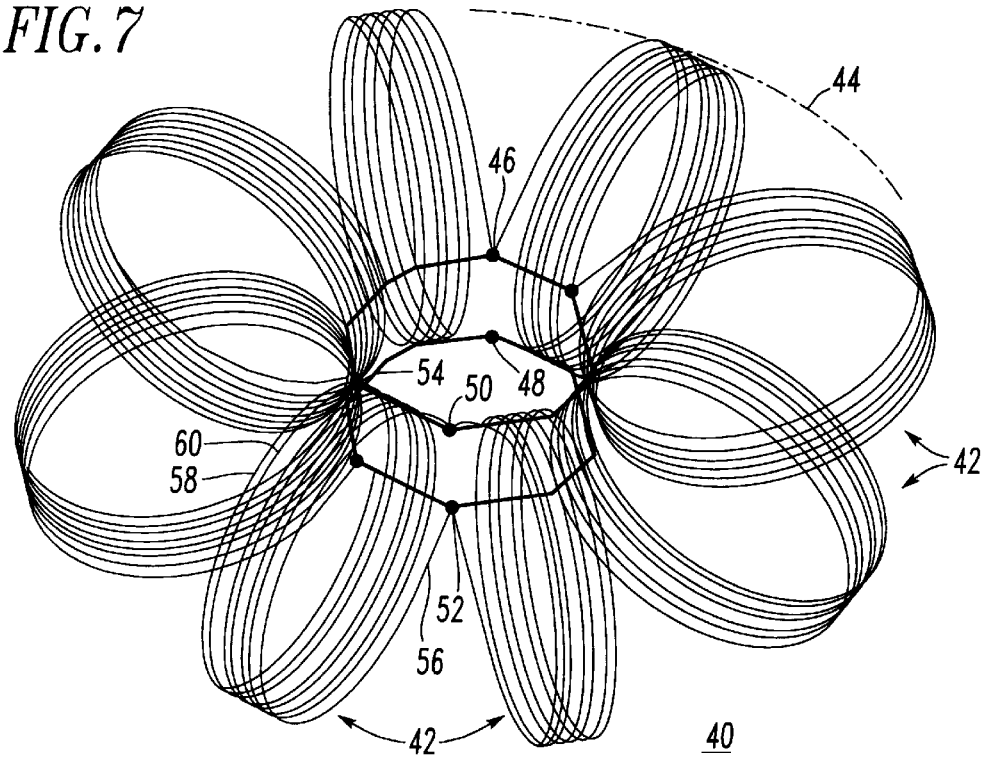
FIG. 7 is an isometric view of a uniform magnetic ring antenna having contrawound windings in accordance with an embodiment of the invention.

The antenna 6 shown in FIG. 1, if physically larger than a CTHA at a given resonance frequency, may be impractical. In accordance with the present invention, exemplary helices arc employed to reduce the size of resonant structures, with care being taken to preserve the uniform magnetic ring. Referring to FIG. 7, the resulting antenna structure 40 (i.e., a segmented CTHA) may be varied to have exemplary contrawound type turns 42, as shown in FIG. 7, or plural closely wound helical turns (as shown with the helical windings 132 of FIG. 14). The plural turns reduce the size of the antenna structure 40, but continue to maintain a resonant structure since the wire length is comparable to the length of a single vertical ring 22 of FIG. 4. These types of contrawound helices (e.g., the toroidal helices 62, 64, 66 of FIG. 8) or the similar contrawound type turns 42 of FIG. 7 have the advantage of preserving poloidal currents, although single helices (not shown) may be employed in place of each of the single vertical rings 22 of FIG. 4.

The exemplary electromagnetic antenna structure 40 of FIG. 7 includes a multiply connected surface, such as the exemplary toroidal surface 44 (shown in hidden line drawing) (i.e., having an exemplary cross-section which is circular); a first conductive loop 46 which is proximate to the surface 44; and a second conductive loop 48 which is proximate to the surface 44. In the exemplary embodiment, the loops 46, 48 have an octagonal shape, although a wide range of loop shapes may be employed (e.g., N-sided, circular, generally circular). First and second signal carrying terminals 50, 52 are electrically connected to the first and second conductive loops 46, 48, respectively. The antenna structure 40 also includes a plurality of conductive transceiver elements, such as the exemplary eight sets of contrawound type turns 42.

Each of the exemplary elements 42 has a first end 54, a plurality of turns (e.g., four turns are shown in FIG. 7), and a second end 56. In the embodiment of FIG. 7, each of the elements 42 extends around and partially about (e.g., about $1/8^{th}$) of the surface 44, although the elements 62, 64, 66 of FIG. 8 extend completely about the corresponding toroidal surface 71. Each of the elements 42 is electrically connected to the first and second conductive loops 46,48, with the first end 54 being electrically connected to the first conductive loop 46, and with the second end 56 (e.g., at terminal 52) being electrically connected to the second conductive loop 48, although the ends 54, 56 may be reversed.

Figure 17:
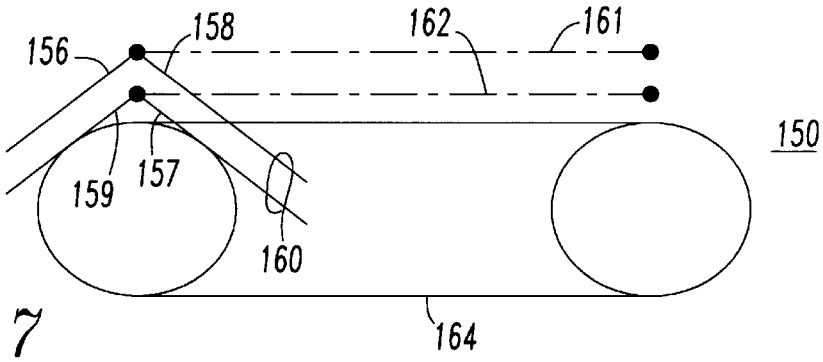
FIGS. 17 and 18 are cross-sectional views of uniform magnetic ring antennas having feed arrangements in accordance with other embodiments of the invention.
Figure 18:
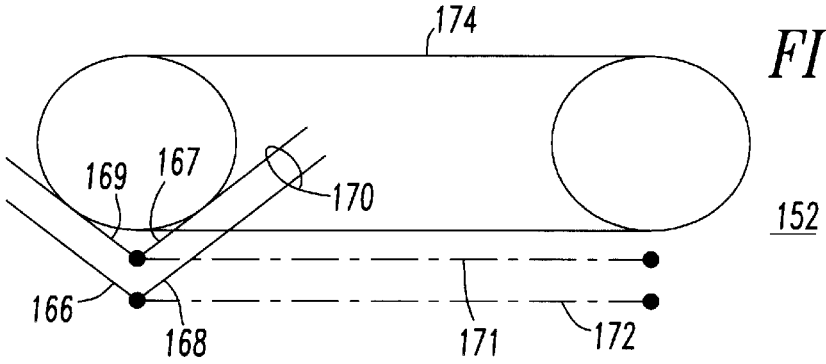
Figure 19:
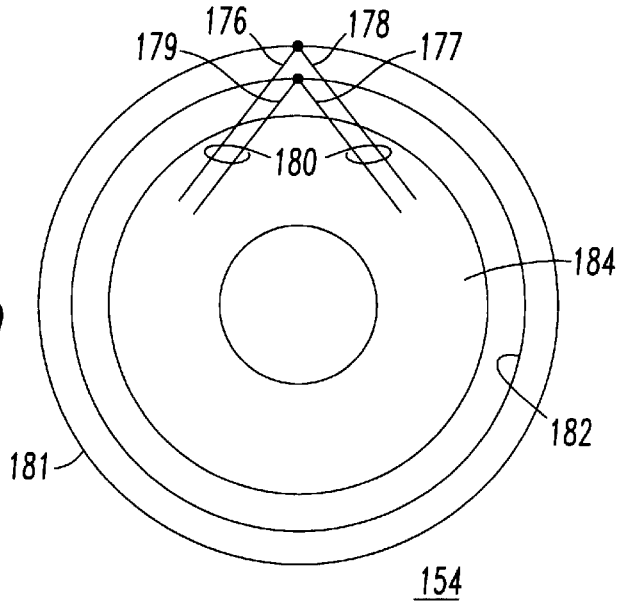
FIG. 19 is a plan view of a uniform magnetic ring antenna having a feed arrangement in accordance with another embodiment of the invention.

In the exemplary embodiment, the ends 54, 56 of each of the elements 42 are electrically connected to the respective conductive loops 46, 48 proximate the inside portion of the cross-section of the toroidal surface 44, although as discussed below in connection with FIGS. 17–19, other portions of that cross-section may be employed. The elements 42 are preferably distributed about an equal partial portion of the conductive loops 46, 48.

Preferably, each of the elements 42 employs two insulated conductor windings 58, 60 having turns, which are disposed in the exemplary contrawound manner. Each of the windings 58, 60 starts on one of the loops 46, 48, but wraps several turns (e.g., about a construction-aid toroidal core (not shown)) before ending such winding on the other one of the loops 46, 48 offset from the starting point. The only direct electrical connection between the exemplary windings 58, 60 and the loops 46, 48 occurs at the ends of the windings 58, 60, not at the intermediate winding positions which are in close proximity to the loops 46, 48.

Alternatively, as shown in FIG. 12, an antenna 100 employs three pairs of contrawound insulated conductor windings 102, 104, 106, and a pair of non-contrawound feed rings 108, 110 having the same pitch sense.

Although pairs of contrawound helices (FIG. 12) or contrawound windings (FIG. 7) are preferably employed, thereby preserving effective poloidal currents, a plurality individual toroidal helices (FIG. 14) or caduceus insulated conductor windings may be employed.

For example, in FIG. 7, the signal carrying terminals 50, 52 are structured to receive an RF signal having a wavelength (λ), with the length of the windings 58, 60 being about one-half (λ/2) of the wavelength. When the antenna structure 40 is employed as a transmitter, for example, the RF signal supplies RF power to each of the exemplary eight elements 42 in order that the same or substantially the same magnitude of current flows in each of the elements. In this manner, the RF signal has a frequency (f), and the conductive loops 46, 48 and the conductive transceiver elements 42 have a resonant frequency, which is the same as the frequency of the RF signal. The circumference of the exemplary loops 46, 48 is substantially smaller (e.g., without limitation, as small as possible, such as 0.01λ, 0.1λ, 0.5λ, 0.75λ, <λ) than the wavelength (λ). Alternatively, the conductive loops 46, 48 may have a circumference which is more than two times λ in size, with the circumference size being selected in order that the elements 42 have substantially the same current flowing therein. As a further alternative, a phase shifting element may be electrically positioned between each adjacent pair of elements 42, in order to reduce the circumference size of the conductive loops 46, 48.

Alternatively, the exemplary vertical elements 42 of FIG. 7 may be replaced by a plurality of toroidal helices, as discussed below, for example, in connection with FIGS. 8–11, which completely traverse about a toroidal surface.

Figure 8:
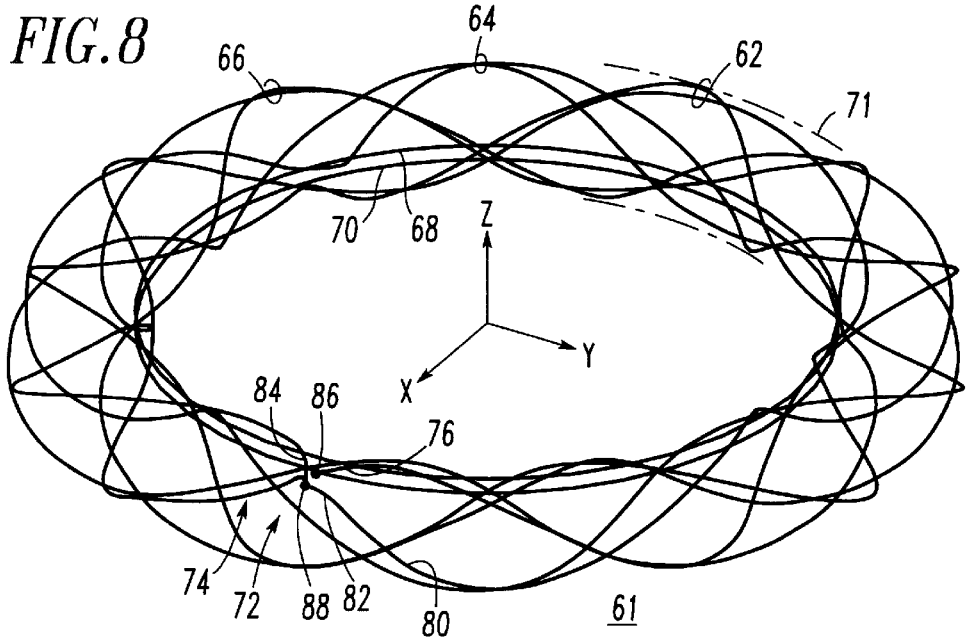
FIG. 8 is an isometric view of another uniform magnetic ring antenna which employs three sets of contrawound toroidal helices in accordance with another embodiment of the invention.
Figure 9:
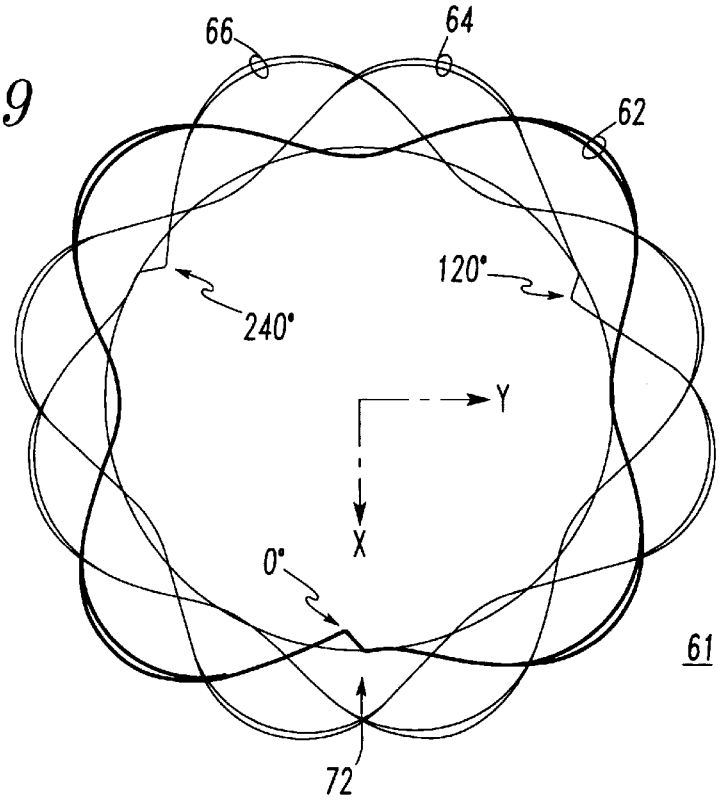
FIG. 9 is a plan view of the three contrawound toroidal helices of FIG. 8.

FIGS. 8 and 9 show a simplified antenna 61 in which three contrawound toroidal helices 62, 64, 66 are distributed evenly about the two exemplary horizontal circular feed rings 68, 70 (shown in FIG. 8) about the exemplary toroidal surface 71 (shown in hidden line drawing in FIG. 8). Each of the exemplary contrawound helices 62, 64, 66 preferably includes at least four turns in order to provide a suitable ring of magnetic field, in which the axial component of the RF current cancels the toroidal component of that current. The exemplary antenna has a feedport 72. For example, in the first contrawound toroidal helix 62, there is a first insulated conductor 74 having a first end 76 and a second end 78, and a second insulated conductor 80 having a first (third) end 82 and a second (fourth) end 84. First and second signal carrying terminals 86, 88 are electrically connected to the first and second feed rings 68, 70, respectively, at the feedport 72. The second and third contrawound toroidal helices 64 and 66 have a similar construction, except that they arc respectively electrically connected to the feed rings 68, 70 at 120 degree and 240 degree offset positions from the feedport 72.

For the three pairs of the contrawound insulated conductor windings, such as windings 74, 80, the toroidal surface 71 of the antenna 61 includes a major circumference which extends 360 degrees; from a 0 degree position at the feedport 72 back to a 360 degree position, which is the 0 degree position. Each of the three contrawound toroidal helices 62, 64, 66 (arid the corresponding insulated conductor windings 74, 80 thereof) is distributed completely about the major circumference and the feed rings 68, 70. The windings of the first contrawound toroidal helix 62 are electrically connected to the feed rings 68, 70 at the 0 degree position. The windings of the second contrawound toroidal helix 64 are electrically connected to the feed rings 68, 70 at the 120 degree position, and the windings of the third contrawound toroidal helix 66 are electrically connected to the feed rings 68, 70 at the 240 degree position.

In particular, the first end 76 of the first winding 74 of the first contrawound toroidal helix 62 is electrically connected to the first feed ring 68 at the 0 degree position, and the second end 78 of the first winding 74 of the first contrawound toroidal helix 62 is electrically connected to the second feed ring 70 at the 360 degree position. In a corresponding manner, the first (third) end 82 of the second winding 80 of the first contrawound toroidal helix 62 is electrically connected to the second feed ring 70 at the 0 degree position, and the second (fourth) end 84 of the second winding 80 of the first contrawound toroidal helix 62 is electrically connected to the first feed ring 68 at the 360 degree position.

In a similar but offset fashion, the first end of the first winding of the second contrawound toroidal helix 64 is electrically connected to the first feed ring 68 at the 120 degree position, and the second end of the first winding of the second contrawound toroidal helix 64 is electrically connected to the second feed ring 70 at the 120 (or 480) degree position (FIG. 9). In a corresponding manner, the first (third) end of the second winding of the second contrawound toroidal helix 64 is electrically connected to the second feed ring 70 at the 120 degree position, and the second (fourth) end of the second winding of the second contrawound toroidal helix 64 is electrically connected to the first feed ring 68 at the 120 degree position.

In a similar but still further offset fashion, the first end of the first winding of the third contrawound toroidal helix 66 is electrically connected to the first feed ring 68 at the 240 degree position, and the second end of the first winding of the third contrawound toroidal helix 66 is electrically connected to the second feed ring 70 at the 240 (or 600) degree position (FIG. 9), which is offset by 120 degrees from the 120 degree and feedport positions. In a corresponding manner, the first (third) end of the second winding of the third contrawound toroidal helix 66 is electrically connected to the second feed ring 70 at the 240 degree position, and the second (fourth) end of the second winding of the third contrawound toroidal helix 66 is electrically connected to the first feed ring 68 at the 240 degree position.

In the exemplary embodiment, the first and second signal carrying terminals 86, 88 are electrically connected to the first and second feed rings 68, 70, respectively, at the feedport 72, which is at the 0 degree position, in order to provide the feedport for the antenna at the exemplary X-axis. Alternatively, the terminals 86, 88 may be electrically connected to the rings 68, 70 at one of the 120 or 240 degree positions. As a still further alternative, a wide range of connection points is possible. For example, the feed points for such antennas may occur anywhere and everywhere (e.g., between 0 and 360 degrees) on the feed rings 68, 70.

Figure 10:
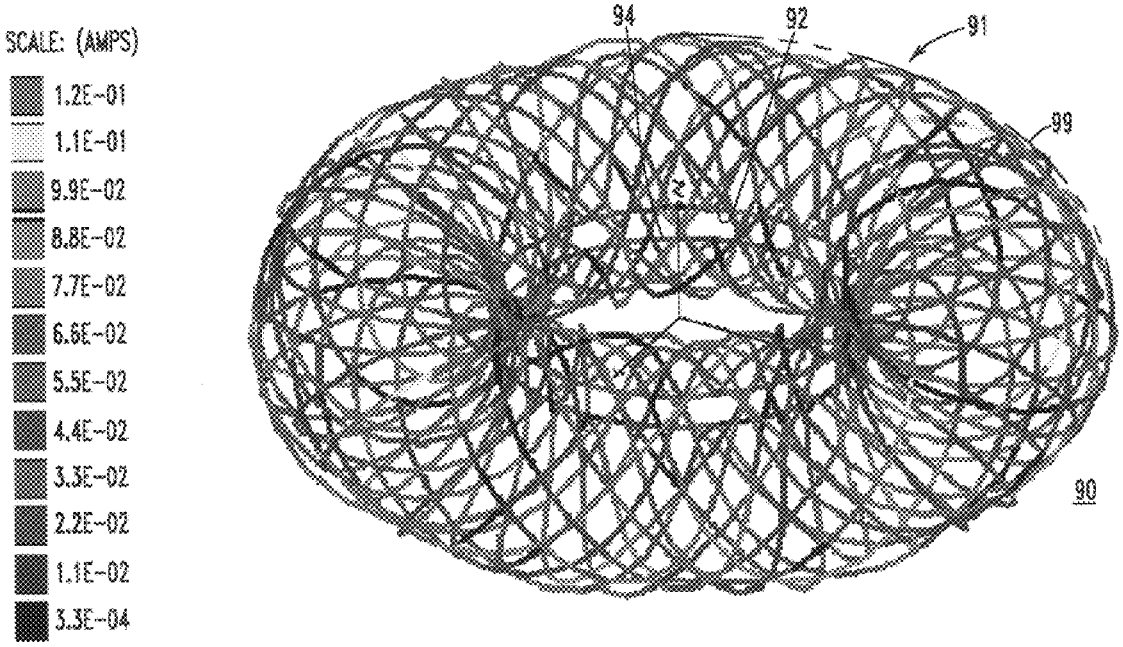
FIG. 10 is a plot of the current distribution of a uniform magnetic ring antenna which employs nine sets of contrawound toroidal helices in accordance with another embodiment of the invention.

FIG. 10 is a plot of the NEC-simulated current distribution 90 for a uniform magnetic ring antenna 91 which, in contrast to the antenna 61 of FIGS. 8 and 9, employs nine contrawound toroidal helices. The exemplary nine helices have four turns and are distributed around exemplary circular feed rings 92, 94. At the frequency (e.g., 360 MHz) employed in this simulation, with 28.80 -j13.54 being the reactance (real and imaginary) for the modeled antenna, the currents are not ideal, although the radiation pattern 96 shown in FIG. 11 has a preferred dipole-like radiation pattern about the origin 98. This configuration preserves effective poloidal currents. The exemplary set of the nine contrawound toroidal helices completely traverse about the toroid 99 (shown in hidden line drawing in FIG. 10) and reduce the size of resonant strictures, thereby preserving the uniform magnetic ring.

Figure 11:
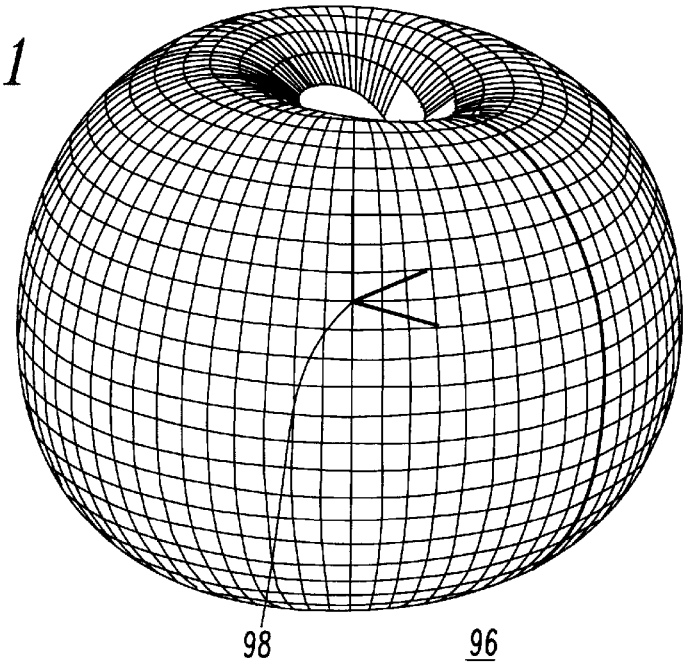
FIG. 11 is a plot of the dipole-like radiation pattern for the antenna of FIG. 10.

In the embodiment of FIGS. 10–11, the antenna 91 employs the toroidal surface 99 having a major circumference which extends 360 degrees from a 0 degree position back to a 360 degree position (i.e., the 0 degree position). Conductive transceiver elements, in the form of the exemplary nine pairs of contrawound toroidal helices, are employed with each of the helices being distributed completely about the major circumference and the conductive loops, in the form of the exemplary circular feed rings 92, 94. A first pair of the helices is electrically connected to the circular feed rings 92, 94 at the 0 degree position, and a second pair of the helices is electrically connected to these rings 92, 94 at a 360/9 degree (i.e., 40 degree) position. Further pairs of the helices are electrically connected to the rings 92, 94 at every 40 degrees, with the ninth pair of the contrawound toroidal helices being electrically connected to the rings 92, 94 at the 320 degree position. The only direct electrical connection between the helices and the rings 92, 94 occurs at the ends of the helices, not at the intermediate winding positions which are in close proximity to the rings 92, 94.

Referring to FIG. 12, a uniform magnetic ring antenna 100 employs three sets of contrawound toroidal helices 102, 104, 106 and a pair of parallel, non-contrawound toroidal helical feed rings 108, 110 having the same pitch sense (e.g., a right-handed pitch, although a left-handed pitch may be employed). Each of the contrawound toroidal helices 102, 104, 106 includes two helices 112, 114 of opposing pitch and having a plurality of turns. This embodiment is an alternative to the exemplary octagonal-shaped loops 46, 48 of FIG. 7 and the exemplary circular feed rings 68, 70 of FIG. 8, in order to create a slower wave device, and decrease the physical size of the antenna 100 at resonance. Also, this more closely decreases the desired ratio (preferably, the ratio is a suitably small value, less than 1, with still smaller values being most desirable) of the feed line (e.g., the loops 46, 48 of FIG. 7, the feed rings 68, 70 of FIG. 8, the feed rings 108, 110 of FIG. 12) length to the radiator ring (e.g., the contrawound type turns 42 of FIG. 7; the contrawound toroidal helices 62, 64, 66 of FIG. 8, the contrawound toroidal helices 102, 104, 106 of FIG. 12) length.

Preferably, the same toroidal surface 115 is employed for both the sets of contrawound toroidal helices 102, 104, 106 and the parallel feed rings 108, 110, although a separate second toroid (e.g., inside, outside, parallel to the toroidal surface 115) may be employed for the parallel feed rings 108, 110. Although three exemplary sets of contrawound toroidal helices 102, 104, 106 are shown, preferably at least eight of those conductive transceiver elements are employed.

Referring to FIG. 13, a uniform magnetic ring antenna 116 employs a plurality of poloidal radiator rings 118 and a pair of contrawound toroidal helical feed rings 120, 122 (i.e., forming a CTHA 123) having opposite pitch senses (e.g., right-hand and left-hand pitch, left-hand and right-hand pitch). In this embodiment, the CTHA 123 formed by the rings 120, 122 replaces the exemplary loops 46, 48, and the poloidal radiator rings 118 replace the exemplary contrawound type turns 42 of FIG. 7. Preferably, the poloidal radiator rings 118 are distributed about the exemplary toroidal surface 124 (shown in hidden line drawing), with the rings 118 being positioned at crossings 126 of the CTHA 123, although other positions may be employed. Similar to the embodiment of FIG. 12, the same toroidal surface 124 is preferably employed for both the CTHA feed rings 120, 122 and the exemplary vertical poloidal rings 118, although a second toroidal surface (e.g., inside, outside, parallel to the toroidal surface 124) may be employed for the CTHA 123. Although an exemplary vertical orientation of the rings 118 is shown, other orientations (e.g., horizontal, an orientation between vertical and horizontal) are possible.

Figure 14:
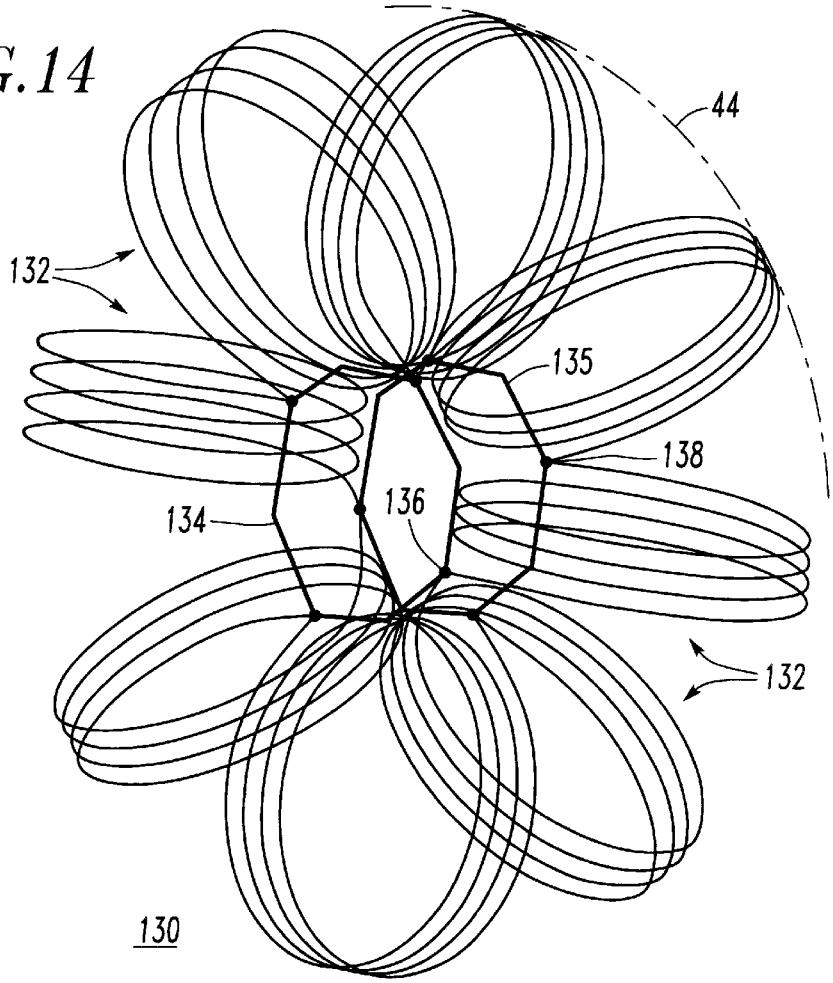
FIG. 14 is an isometrics view of another uniform magnetic ring antenna having eight helical windings in accordance with another embodiment of the invention.

Referring to FIG. 14, as a further alternative to the antenna 40 of FIG. 7, a uniform magnetic ring antenna 130 has eight insulated conductor helical windings 132. In this embodiment, the exemplary antenna 130 has a vertical orientation, although other orientations (e.g., horizontal, an orientation between vertical and horizontal) are possible. Each of the windings 132 has a plurality of turns, thereby forming eight helices. Although exemplary "right-hand" windings are shown, "left-hand" windings may be employed. Preferably, in order to provide a more uniform radiation pattern, at least eight of: (a) the windings 132 of FIG. 14; (b) the contrawound toroidal helices 102, 104, 106 of FIG. 12; or (c) the poloidal radiator rings 118 of FIG. 13 are employed.

Each of the windings 132 starts on one of the feed loops 134, 135, but wraps several turns (e.g., about a construction-aid toroidal core (not shown)) before ending such winding on the other one of the loops 134, 135 in the vicinity of the next such winding. The only direct electrical connection between the windings 132 and the loops 134, 135 occurs at the ends 136, 138 of the windings 132, not at the intermediate winding positions which are in close proximity to the loops 134, 135.

Figure 15:
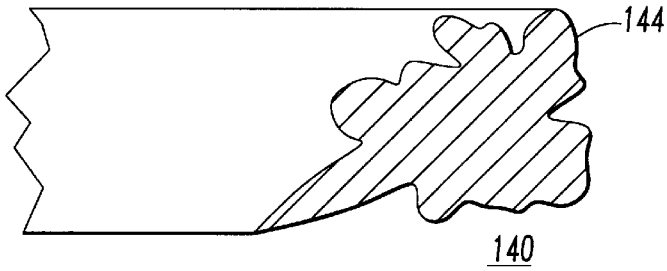
FIG. 15 PRIOR ART
FIGS. 15 and 16 are cross-sectional views of alternative multiply connected surfaces.
Figure 16:
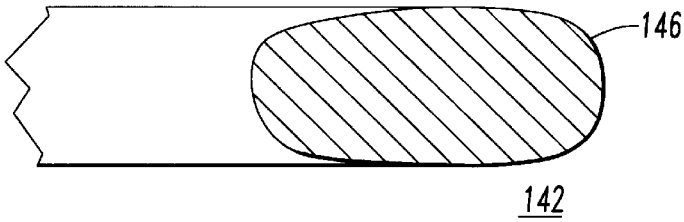
FIG. 16 PRIOR ART

FIGS. 15 and 16 show other variations of multiply connected surfaces 140 and 142, respectively. The surface 140 has a cross-section 144, which is a generally connected form. The surface 142 is a generalized toroid having a cross-section 146, which is non-circular (e.g., oval, elliptical, egg-shaped).

The antenna 61 of FIG. 8 has a feed arrangement in which the toroidal helices 62, 64, 66 are electrically connected to the horizontal circular feed rings 68, 70 at the inside portion of the exemplary toroidal surface 71. FIGS. 17, 18 and 19 show other embodiments of uniform magnetic ring antennas 150, 152 and 154, respectively. As shown in FIG. 17, the ends 156, 157, 158, 159 of each of the conductive transceiver elements 160 are electrically connected to the first and second conductive loops 161, 162 at the top portion of the cross-section of the exemplary toroidal surface 164. In FIG. 18, the ends 166, 167, 168, 169 of each of the conductive transceiver elements 170 are electrically connected to the first and second conductive loops 171, 172 at the bottom portion of the cross-section of the exemplary toroidal surface 174. In FIG. 19, the ends 176, 177, 178, 179 of each of the conductive transceiver elements 180 are electrically connected to the first and second conductive loops 181, 182 at the outside portion of the cross-section of the exemplary toroidal surface 184.

Referring to FIGS. 20 and 21, two further variations of the uniform magnetic ring antenna 61 of FIG. 8 are shown. The exemplary antenna 190 of FIG. 20 has a feedport 192 at the 120 degree position, while the exemplary antenna 194 of FIG. 21 has a feedport 196 at the 240 degree position of FIG. 8. The feedport 72 of the antenna 61 of FIG. 8 is at the 0 degree position. In a similar fashion, the feedport of an antenna (not shown) having "n" (e.g., nine) pair of the contrawound toroidal helices, as for FIGS. 10 and 11, may be positioned at one of nine positions every 360/n degrees (e.g., 0 degrees, 40 degrees, 80 degrees, . . . , 320 degrees). Alternatively, the feed point may be positioned at any position (e.g., 0 to 360 degrees).

Figure 22:
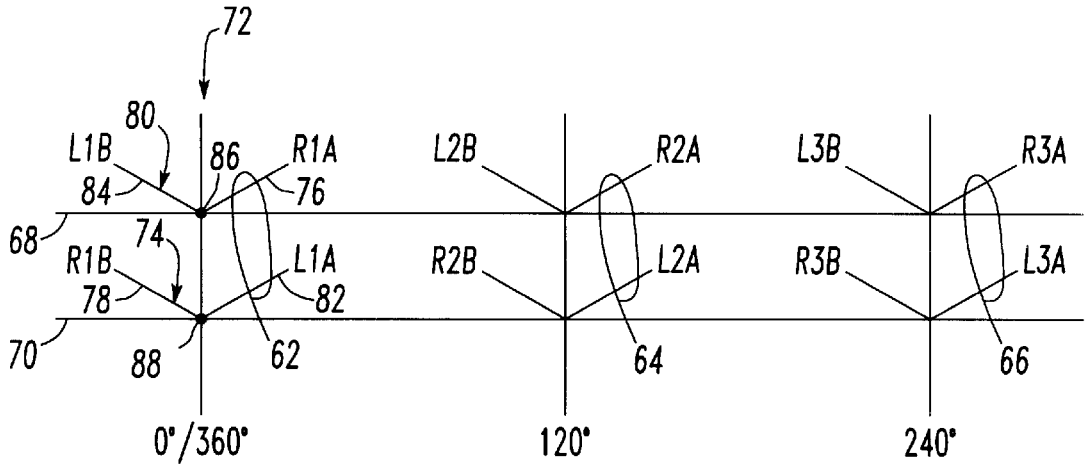
FIG. 22 is a simplified schematic diagram showing the electrical connections between the contrawound toroidal helices and the conductive feed rings for the antenna of FIG. 8.

FIG. 22 is a simplified schematic diagram which shows the electrical connections between the contrawound toroidal helices 62, 64, 66 and the feed rings 68, 70 for the antenna 61 of FIG. 8. The exemplary feedport 72 is at the 0 degree position. The first contrawound toroidal helix 62 has the first insulated conductor (R1, which has an exemplary right-hand winding) 74 having the first end (R1A) 76 electrically connected to the feed ring 68 and the second end (R1B) 78 electrically connected to the feed ring 70, and the second insulated conductor (L1, which has an exemplary left-hand winding) 80 has the first (third) end (L1A) 82 electrically connected to the feed ring 70 and the second (fourth) end (L1B) 84 electrically connected to the feed ring 68. The first and second signal carrying terminals 86, 88 are electrically connected to the first and second feed rings 68, 70, respectively, at the feedport 72. The second and third contrawound toroidal helices 64 and 66 have a similar construction, except that they are respectively electrically connected to the feed rings 68, 70 at 120 degree and 240 degree offset positions from the feedport 72.

Figure 23:
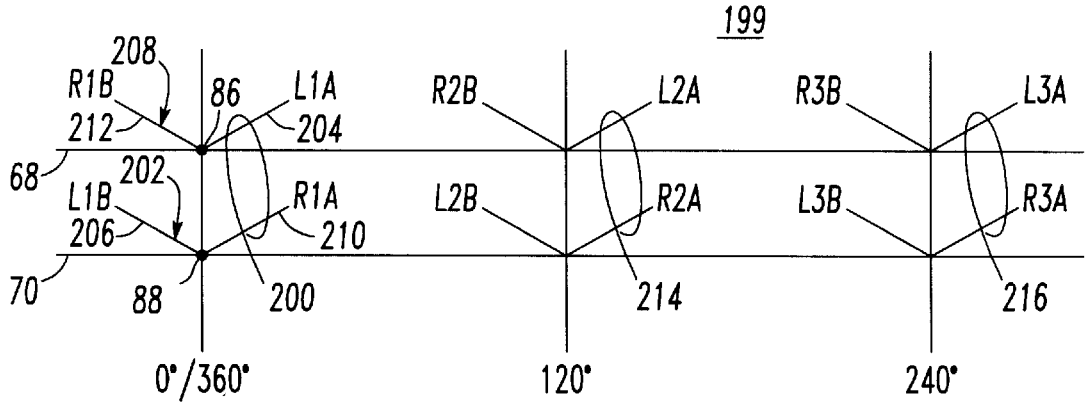
FIGS. 23–25 are simplified schematic diagrams showing the electrical connections between the contrawound toroidal helices and the conductive feed rings for antennas in accordance with other embodiments of the invention.

FIG. 23 is a simplified schematic diagram of another antenna 199. The antenna 199 is similar to the antenna 61 of FIGS. 8 and 22, except that the first contrawound toroidal helix 200 has a first insulated conductor (L1, which has an exemplary left-hand winding) 202 with a first end (L1A) 204 electrically connected to the feed ring 68 and a second end (L1B) 206 electrically connected to the feed ring 70, and a second insulated conductor (R1, which has an exemplary right-hand winding) 208 having a first end (R1A) 210 electrically connected to the feed ring 70 and a second end (R1B) 212 electrically connected to the feed ring 68. The other contrawound toroidal helices 214, 216 are similarly connected (e.g., the first ends L2A and L3A of the left-hand windings of the contrawound toroidal helices 214, 216 are electrically connected to the feed ring 68, and the second ends L2B and L3B thereof are electrically connected to the feed ring 70; and the first ends R2A and R3A of the right-hand windings of the contrawound toroidal helices 214, 216 arc electrically connected to the feed ring 70, and the second ends R2B and R3B thereof are electrically connected to the feed ring 68).

Figure 24:
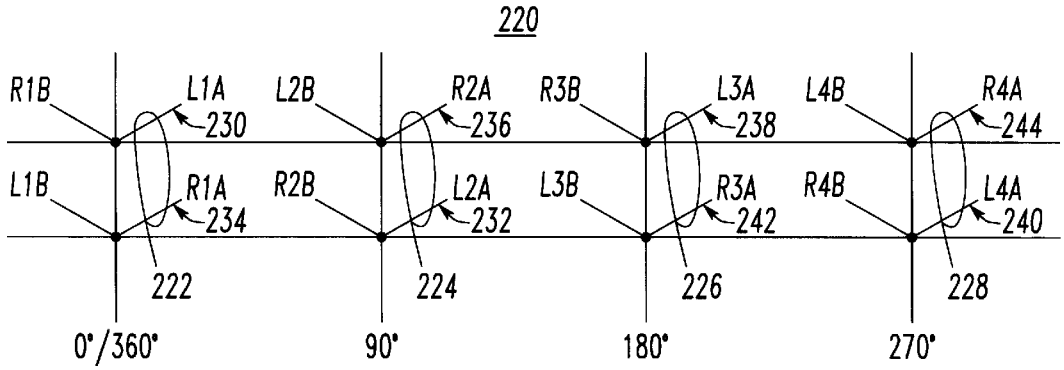

FIG. 24 is a simplified schematic diagram of another antenna 220. The antenna 220 is similar to the antenna 199 of FIG. 23, except that four contrawound toroidal helices 222, 224, 226, 228 are employed, and the first conductor 230 of the first helix 222 and the second conductor 232 of the second helix 224 have an opposing pitch (e.g., left-hand) with respect to the pitch (e.g., right-hand) of the second conductor 234 of the first helix 222 and the first conductor 236 of the second helix 224. Similarly, the first conductor 238 of the third helix 226 and the second conductor 240 of the fourth helix 228 have the opposing pitch (e.g., left-hand) with respect to the pitch (e.g., right-hand) of the second conductor 242 of the third helix 226 and the first conductor 244 of the fourth helix 228.

Figure 25:
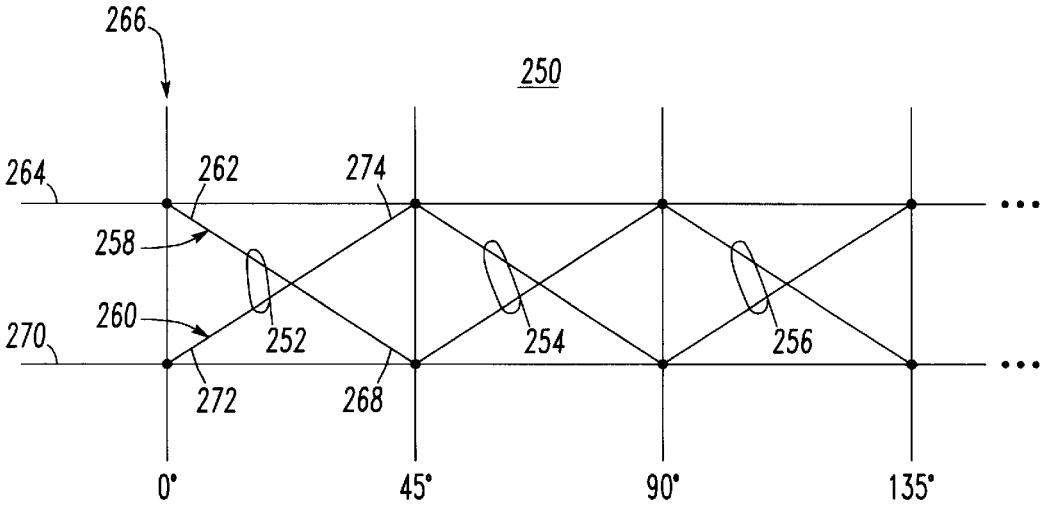

FIG. 25 is a simplified schematic diagram of another antenna 250. The antenna 250 has eight exemplary conductive transceiver elements (only three are shown), such as the contrawound toroidal helices 252, 254, 256, each of which has an exemplary right-hand helix 258 and an exemplary left-hand helix 260 (as shown with contrawound toroidal helix 252). The first end 262 of the right-hand helix 258 is electrically connected to a first feed ring 264 at the feedport 266, and the second end 268 of the right-hand helix 258 is electrically connected to the second feed ring 270 at a position offset (e.g., 45 degrees) from the feedport position. The second (fourth) end 272 of the left-hand helix 260 is electrically connected to the second feed ring 270 at the feedport position and the first (third) end 274 of the left-hand helix 260 is electrically connected to the first feed ring 264 at the offset position. The contrawound helices, such as 254, 256, are similarly connected to the feed rings 264, 270, for example, between the 45 and 90 degree, and 90 and 135 degree positions, respectively. The remaining helices are similarly connected at subsequent offset positions (not shown).

Figure 26:
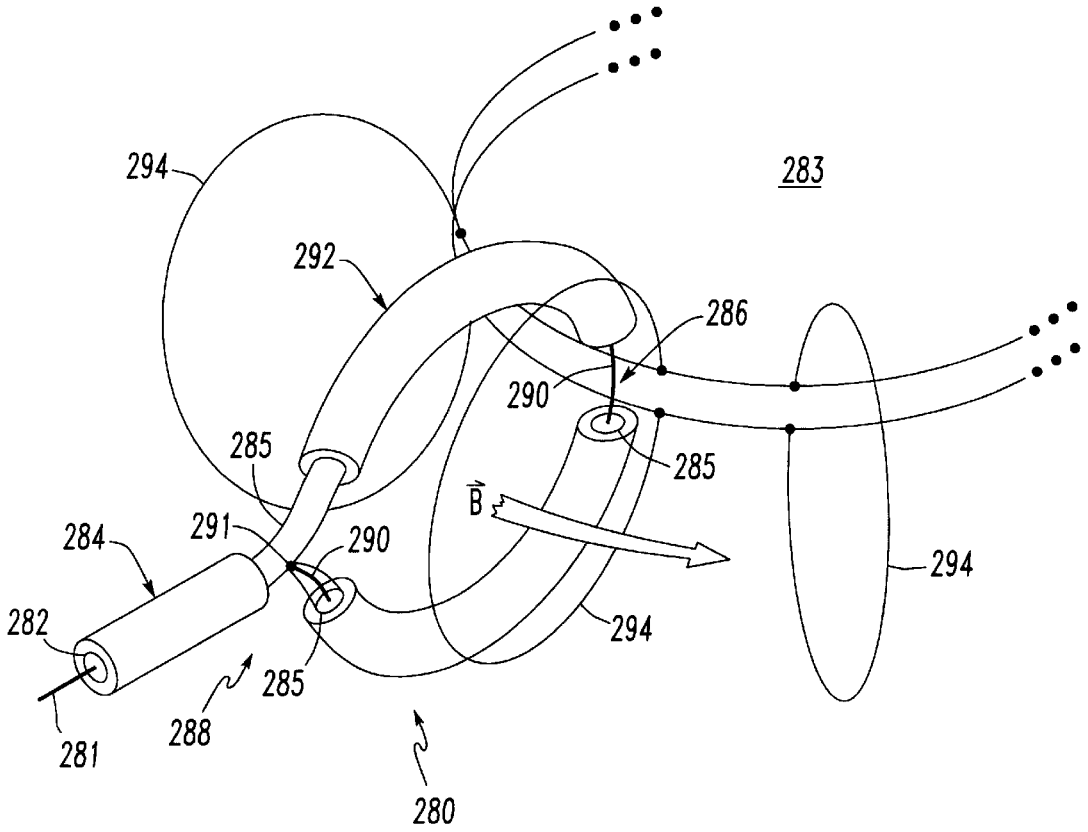
FIG. 26 is a block diagram showing magnetic coupling between signal carrying terminals of a shielded loop and an antenna loop in accordance with another embodiment of the invention.

FIG. 26 shows an example of a conventional shielded loop 280 which is employed to magnetically couple an RF signal at signal carrying terminals 281, 282 to or from an antenna 283, which is similar to the antenna 16 of FIG. 4. The shielded loop 280 is formed by a coaxial cable 284 (e.g., 50Ω), in which the shield 285 is cut at 286 and 288 to expose the center conductor 290. In turn, the center conductor 290 and the corresponding shield 285 are electrically connected to the exposed shield 285 at 291. The exposed center conductor 290 at 286 serves to stop the current flow in the shield 285. Although no electrical connection is made from the coupling loop 292 to the antenna 283, the loop 292 is suitably positioned in proximity to the exemplary antenna loop 294, and preferably without passing completely around the exemplary toroidal surface, in order to couple and match RF energy to or from the antenna 283. Preferably, the size of the loop 292 is relatively small with respect to the wavelength, λ, of the RF signal at terminals 281, 282.

The exemplary conductive paths of the antennas disclosed herein may be arranged in other than a helical fashion, such as a generally helical fashion, a spiral fashion, a caduceus fashion or any contrawound fashion, and still satisfy the spirit of this invention. The conductive paths may further be contrawound "poloidal-peripheral winding patterns" having opposite winding senses (e.g., the helix formed by each of two insulated conductors is decomposed into a series of interconnected poloidal loops) (see, for example, U.S. Pat. No. 5,442,369).

Although exemplary insulated conductor windings are disclosed herein, such as 102, 104, 106, such conductors need not be entirely insulated. In other words, such conductors, while being isolated from each other (except at points where electrical connections are intended), may employ other forms of insulation (e.g., without limitation, air gaps).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An electromagnetic antenna comprising:

a multiply connected surface;

a first conductive loop proximate to said multiply connected surface;

a second conductive loop proximate to said multiply connected surface;

first and second signal carrying terminals operatively associated with said first and second conductive loops, respectively; and a plurality of conductive transceiver elements, each of said conductive transceiver elements having a first end, a plurality of turns, and a second end, with each of said conductive transceiver elements extending around and at least partially about said multiply connected surface, and with each of said conductive transceiver elements being electrically connected to said first and second conductive loops, with the first end of each of said conductive transceiver elements being electrically connected to one of said first and second conductive loops, and with the second end of each of said conductive transceiver elements being electrically connected to the other of said first and second conductive loops.

2. The electromagnetic antenna of claim 1, wherein said conductive transceiver elements include insulated conductor windings.

3. The electromagnetic antenna of claim 2, wherein said insulated conductor windings are insulated conductor helical windings.

4. The electromagnetic antenna of claim 1, wherein said conductive transceiver elements include pairs of contrawound insulated conductor windings.

5. The electromagnetic antenna of claim 4, wherein said pairs of contrawound insulated conductor windings form contrawound helices.

6. The electromagnetic antenna of claim 4, wherein each of said contrawound insulated conductor windings includes a first insulated conductor having the first end and the second end, and a second insulated conductor having a third end and a fourth end.

7. The electromagnetic antenna of claim 6, wherein said conductive transceiver elements include three pair of said contrawound insulated conductor windings.

8. The electromagnetic antenna of claim 7, wherein each of said contrawound insulated conductor windings includes four turns.

9. The electromagnetic antenna of claim 7, wherein said multiply connected surface includes a major circumference which extends 360 degrees from a 0 degree position back to a 360 degree position, which is said 0 degree position; wherein each of said three pair of said contrawound insulated conductor windings is distributed completely about said major circumference and said first and second conductive loops, with a first pair of said contrawound insulated conductor windings being electrically connected to said first and second conductive loops at the 0 degree position, with a second pair of said contrawound insulated conductor windings being electrically connected to said first and second conductive loops at a 120 degree position, and with a third pair of said contrawound insulated conductor windings being electrically connected to said first and second conductive loops at a 240 degree position.

10. The electromagnetic antenna of claim 9, wherein said first and second signal carrying terminals are electrically connected to said first and second conductive loops at the 0 degree position.

11. The electromagnetic antenna of claim 9, wherein said first and second signal carrying terminals are electrically connected to said first and second conductive loops at the 120 degree position.

12. The electromagnetic antenna of claim 9, wherein said first and second signal carrying terminals are electrically connected to said first and second conductive loops at the 240 degree position.

13. The electromagnetic antenna of claim 9, wherein each of said three pair of said contrawound insulated conductor windings includes a first insulated conductor having the first end and the second end, and a second insulated conductor having the third end and the fourth end.

14. The electromagnetic antenna of claim 13, wherein the first end of the first insulated conductor of the first pair of said contrawound insulated conductor windings is electrically connected to the first conductive loop at the 0 degree position and the second end of said first insulated conductor is electrically connected to the second conductive loop at the 360 degree position; and wherein the first end of the second insulated conductor of the first pair of said contrawound insulated conductor windings is electrically connected to the second conductive loop at the 0 degree position and the second end of said second insulated conductor is electrically connected to the first conductive loop at the 360 degree position.

15. The electromagnetic antenna of claim 14, wherein the first end of the first insulated conductor of the second pair of said contrawound insulated conductor windings is electrically connected to the first conductive loop at the 120 degree position and the second end of said first insulated conductor is electrically connected to the second conductive loop at the 120 degree position; and wherein the first end of the second insulated conductor of the second pair of said contrawound insulated conductor windings is electrically connected to the second conductive loop at the 120 degree position and the second end of said second insulated conductor is electrically connected to the first conductive loop at the 120 degree position.

16. The electromagnetic antenna of claim 15, wherein the first end of the first insulated conductor of the third pair of said contrawound insulated conductor windings is electrically connected to the first conductive loop at the 240 degree position and the second end of said first insulated conductor is electrically connected to the second conductive loop at the 240 degree position; and wherein the first end of the second insulated conductor of the third pair of said contrawound insulated conductor windings is electrically connected to the second conductive loop at the 240 degree position and the second end of said second insulated conductor is electrically connected to the first conductive loop at the 240 degree position.

17. The electromagnetic antenna of claim 1, wherein said conductive transceiver elements are caduceus insulated conductor windings.

18. The electromagnetic antenna of claim 1, wherein said antenna has a horizontal orientation.

19. The electromagnetic antenna of claim 1, wherein said antenna has a vertical orientation.

20. The electromagnetic antenna of claim 1, wherein said multiply connected surface is a toroidal surface.

21. The electromagnetic antenna of claim 1, wherein said multiply connected surface has a cross-section which is circular.

22. The electromagnetic antenna of claim 1, wherein said multiply connected surface has a cross-section which is a generally connected form.

23. The electromagnetic antenna of claim 22, wherein said cross-section has a top portion, a bottom portion, an inside portion, and an outside portion with respect to said multiply connected surface.

24. The electromagnetic antenna of claim 23, wherein the first and second ends of each of said conductive transceiver elements are electrically connected to said first and second conductive loops at said top portion of said cross-section.

25. The electromagnetic antenna of claim 23, wherein the first and second ends of each of said conductive transceiver elements are electrically connected to said first and second conductive loops at said bottom portion of said cross-section.

26. The electromagnetic antenna of claim 23, wherein the first and second ends of each of said conductive transceiver elements are electrically connected to said first and second conductive loops al said inside portion of said cross-section.

27. The electromagnetic antenna of claim 23, wherein the first and second ends of each of said conductive transceiver elements are electrically connected to said first and second conductive loops at said outside portion of said cross-section.

28. The electromagnetic antenna of claim 1, wherein said first and second conductive loops are conductive circular rings.

29. The electromagnetic antenna of claim 1, wherein said first and second conductive loops have a generally circular form.

30. The electromagnetic antenna of claim 1, wherein said first and second conductive loops have a circumference; wherein said first and second signal carrying terminals are structured to transmit or receive a radio frequency (RF) signal having a wavelength; and wherein said circumference is substantially smaller than said wavelength.

31. The electromagnetic antenna of claim 30, wherein said RF signal supplies RF power to each of said conductive transceiver elements in order that the same or substantially the same magnitude of current flows in each of said elements.

32. The electromagnetic antenna of claim 1, wherein each of said conductive transceiver elements has a length; wherein said first and second signal carrying terminals are structured to transmit or receive a radio frequency (RF) signal having a wavelength; and wherein said length is about one-half of said wavelength.

33. The electromagnetic antenna of claim 32, wherein said RF signal supplies RF power to each of said conductive transceiver elements in order that the same or substantially the same magnitude of current flows in each of said elements.

34. The electromagnetic antenna of claim 33, wherein said RF signal has a frequency; and wherein said first and second conductive loops and said conductive transceiver elements have a resonant frequency which is the same as the frequency of said RF signal.

35. The electromagnetic antenna of claim 1, wherein said conductive transceiver elements include at least eight of said elements.

36. The electromagnetic antenna of claim 1, wherein each of said conductive transceiver elements is distributed about an equal portion of said first and second conductive loops.

37. The electromagnetic antenna of claim 1, wherein said multiply connected surface is a toroid having a cross-section which is circular; and wherein said turns are helical turns.

38. The electromagnetic antenna of claim 1, wherein said multiply connected surface is a generalized toroid having a cross-section which is non-circular.

39. The electromagnetic antenna of claim 1, wherein the turns of each of said conductive transceiver elements form a helix.

40. The electromagnetic antenna of claim 1, wherein the turns of each of said conductive transceiver elements include a plurality of contrawound turns.

41. The electromagnetic antenna of claim 1, wherein said conductive transceiver elements include at least eight helices.

42. The electromagnetic antenna of claim 1, wherein said conductive transceiver elements include at least eight of said elements each of which includes two helices of opposing pitch.

43. The electromagnetic antenna of claim 42, wherein each of said helices includes four turns.

44. The electromagnetic antenna of claim 1, wherein each of said conductive transceiver elements includes two helices of opposing pitch; and wherein said helices of opposing pitch include a first insulated conductor having the first end and the second end, and a second insulated conductor having a third end and a fourth end.

45. The electromagnetic antenna of claim 44, wherein said first and second signal carrying terminals are electrically connected to said first and second conductive loops at a feedport position; wherein the first end of the first insulated conductor of a first conductive transceiver element is electrically connected to the first conductive loop at the feedport position and the second end of said first insulated conductor is electrically connected to the second conductive loop at a position offset from said feedport position; and wherein the second end of the second insulated conductor of said first conductive transceiver element is electrically connected to the second conductive loop at the feedport position and the first end of said second insulated conductor is electrically connected to the first conductive loop at the offset position.

46. The electromagnetic antenna of claim 45, wherein the first end of the first insulated conductor of a second conductive transceiver element is electrically connected to the first conductive loop at the offset position and the second end of said first insulated conductor is electrically connected to the second conductive loop at a position offset from said offset and feedport positions; and wherein the second end of the second insulated conductor of said first conductive transceiver element is electrically connected to the second conductive loop at the offset position and the first end of said second insulated conductor is electrically connected to the first conductive loop at said position offset from said offset and feedport positions.

47. The electromagnetic antenna of claim 46, wherein the first insulated conductors of said conductive transceiver elements have said opposing pitch with respect to the second insulated conductors of said conductive transceiver elements.

48. The electromagnetic antenna of claim 46, wherein the first insulated conductor of the first conductive transceiver element and the second insulated conductor of the second conductive transceiver element have said opposing pitch with respect to the second insulated conductor of the first conductive transceiver element and the first insulated conductor of the second conductive transceiver element.

49. The electromagnetic antenna of claim 44, wherein said first and second signal carrying terminals are electrically connected to said first and second conductive loops at a feedport position; wherein the second end of the first insulated conductor of a first conductive transceiver element is electrically connected to the first conductive loop at the feedport position and the first end of said first insulated conductor is electrically connected to the second conductive loop at a position offset from said feedport position; and wherein the first end of the second insulated conductor of said first conductive transceiver clement is electrically connected to the second conductive loop at the feedport position and the second end of said second insulated conductor is electrically connected to the first conductive loop at the offset position.

50. The electromagnetic antenna of claim 49, wherein the second end of the first insulated conductor of a second conductive transceiver clement is electrically connected to the first conductive loop at the offset position and the first end of said first insulated conductor is electrically connected to the second conductive loop at a position offset from said offset and feedport positions; and wherein the first end of the second insulated conductor of said first conductive transceiver element is electrically connected to the second conductive loop at the offset position and the second end of said second insulated conductor is electrically connected to the first conductive loop at said position offset from said offset and feedport positions.

51. The electromagnetic antenna of claim 50, wherein the first insulated conductors of said conductive transceiver elements have said opposing pitch with respect to the second insulated conductors of said conductive transceiver elements.

52. The electromagnetic antenna of claim 50, wherein the first insulated conductor of the first conductive transceiver element and the second insulated conductor of the second conductive transceiver element have said opposing pitch with respect to the second insulated conductor of the first conductive transceiver element and the first insulated conductor of the second conductive transceiver element.

53. The electromagnetic antenna of claim 1, wherein said multiply connected surface is a toroidal surface which includes a major circumference which extends 360 degrees from a 0 degree position back to a 360 degree position, which is said 0 degree position; wherein said conductive transceiver elements include N pairs of contrawound toroidal helices; wherein each pair of said contrawound toroidal helices is distributed completely about said major circumference and said first and second conductive loops, with a first pair of said contrawound toroidal helices being electrically connected to said first and second conductive loops at the 0 degree position, with a second pair of said contrawound toroidal helices being electrically connected to said first and second conductive loops at a 360/N degree position, and with an "nth" pair of said contrawound toroidal helices being electrically connected to said first and second conductive loops at a 360(n−1)/N degree position.

54. The electromagnetic antenna of claim 1, wherein said multiply connected surface is a toroidal surface which includes a major circumference which extends 360 degrees from a 0 degree position back to a 360 degree position, which is said 0 degree position; wherein said conductive transceiver elements include N pairs of contrawound toroidal helices; wherein each pair of said contrawound toroidal helices is distributed completely about said major circumference and said first and second conductive loops, with a first pair of said contrawound toroidal helices being electrically connected to said first and second conductive loops at an M degree position, with M being greater than 0 and less than 360, with a second pair of said contrawound toroidal helices being electrically connected to said first and second conductive loops at a 360/N +M degree position, and with an "nth" pair of said contrawound toroidal helices being electrically connected to said first and second conductive loops at a 360(n-1)/N +M degree position.

55. The electromagnetic antenna of claim 1, wherein said first and second conductive loops form a pair of parallel toroidal helices having the same pitch sense.

56. The electromagnetic antenna of claim 1, wherein said first and second conductive loops form a contrawound toroidal helical antenna.

57. The electromagnetic antenna of claim 1, wherein said first and second signal carrying terminals are structured to transmit or receive a radio frequency signal having a wavelength.

58. The electromagnetic antenna of claim 57, wherein said first and second conductive loops have a circumference which is substantially smaller than said wavelength, in order that said conductive transceiver elements have substantially the same current flowing therein.

59. The electromagnetic antenna of claim 58, wherein said first and second conductive loops have a circumference which is more than two times said wavelength in size; and wherein said circumference size is selected, in order that said conductive transceiver elements have substantially the same current flowing therein.

60. The electromagnetic antenna of claim 59, wherein a phase shifting element is electrically positioned between each adjacent pair of said conductive transceiver elements, in order to reduce said circumference size of said conductive loops.

* * * * *

UNITED STATES PATENT AND TRADEMARK OFFICE

CERTIFICATE OF CORRECTION

PATENT NO. : 6,300,920 B1
DATED : October 9, 2001
INVENTOR(S) : Franz A. Pertl et al.

It is certified that error appears in the above-identified patent and that said Letters Patent is hereby corrected as shown below:

Column 3,
Line 54, “isometrics” should read -- isometric --.

Column 5,
Line 26, “arc” should read -- are --.

Column 7,
Line 8, “arc” should read -- are --.
Line 17, “arid” should read -- and --.

Column 10,
Line 62, “arc” should read -- are --.

Column 11,
Line 38, “50Ω)” should read -- 50 Ω) --.

Column 14,
Line 25, “al” should read -- at --.

Column 16,
Lines 9 and 16, “clement” should read -- element --.

Signed and Sealed this

Eleventh Day of June, 2002

*Attest:*

*Attesting Officer*

JAMES E. ROGAN
*Director of the United States Patent and Trademark Office*